United States Patent [19]

Denisart et al.

[11] 4,103,971

[45] Aug. 1, 1978

[54] METHOD FOR BREAKING ROCK BY DIRECTING HIGH VELOCITY JET INTO PRE-DRILLED BORE

[75] Inventors: Jean-Paul Denisart, Lutry; Barry E. Edney; Chapman Young, both of Lausanne, all of Switzerland

[73] Assignee: Atlas Copco Aktiebolag, Nacka, Sweden

[21] Appl. No.: 719,246

[22] Filed: Aug. 31, 1976

[30] Foreign Application Priority Data

Sep. 19, 1975 [SE] Sweden ..... 7510556

[51] Int. Cl.[2] ..... E21C 37/12

[52] U.S. Cl. ..... 299/17; 175/67

[58] Field of Search ..... 299/16, 17; 175/67; 239/101

[56] References Cited

U.S. PATENT DOCUMENTS

| | | | |
|---|---|---|---|
| 3,231,031 | 1/1966 | Cleary | 175/67 |
| 3,572,839 | 3/1971 | Okabe | 299/17 |
| 3,988,037 | 10/1976 | Denisart et al. | 299/16 |

FOREIGN PATENT DOCUMENTS

| | | | |
|---|---|---|---|
| 438,180 | 11/1967 | Switzerland | 299/16 |
| 897,879 | 5/1962 | United Kingdom | 299/16 |

*Primary Examiner*—Ernest R. Purser
*Attorney, Agent, or Firm*—Flynn & Frishauf

[57] ABSTRACT

A hard compact material such as rock is broken by directing a high velocity jet of relatively incompressible fluid, such as water, into a hole which is drilled in the material to be broken. The jet is generated by a nozzle in alignment with the hole and is suddenly arrested in the hole in appropriate position with respect to adjacent free surfaces of the material. A jet stagnation pressure is created in the hole of sufficient magnitude and duration or jet repetion rate to break the material towards the free surfaces. Preferably, a secondary nozzle emits fluid for filling partially or wholly the hole prior to generating the high velocity jet by a primary nozzle.

13 Claims, 4 Drawing Figures

METHOD FOR BREAKING ROCK BY DIRECTING HIGH VELOCITY JET INTO PRE-DRILLED BORE

BACKGROUND OF THE INVENTION

During the last decade serious attention has been given to replacing the drill and blast technique for tunneling, mining and similar operations. One alternative technique involves the use of high velocity jets of water or other liquid to fracture the rock or ore body and numerous devices intended to produce pulsed or intermittent liquid jets of sufficiently high velocity to fracture even the hardest rock have been suggested. Such devices are disclosed in for example U.S. Pat. Nos. 3,784,103 and 3,796,371. As yet, however, jet cutting techniques are still unable to compete with the traditional methods of rock breakage such as drill and blast in terms of advance rate, energy consumption or overall cost. Moreover serious technical problems such as the fatigue of parts subjected to pressures as high as 10 or 20 kbar and excessive operational noise remain.

A second and even older technique for fracturing the rock and for saturating soft rock formations such as coal with water for dust suppression involves drilling a hole in the rock and thereafter pressurizing the hole with water either statically or dynamically. This second technique is described in for example German Pat. Nos. 230,082, 241,966 and 1,017,563.

These methods are inapplicable to hard rock formations because of the restriction in working pressure which can be realized or usefully utilized with conventional hydraulic pumps. They are difficult to apply in practice particularly in soft crumbling rock or badly fissured rock in that the bore hole must be effectively sealed around the tube introduced into the hole through which the liquid is pumped. These restrictions in all make the method far less versatile than drill and blast.

SUMMARY OF THE INVENTION

It is an object of the invention to provide method and means for breaking hard compact material such as rock by pulsed or intermittent jet devices which are operated to hydraulically pressurize holes having been drilled into the material beforehand.

For these and other purposes there is according to one aspect of the invention provided a method of breaking hard compact material, such as rock, comprising drilling a hole into the material, generating by a nozzle in alignment with the hole a high velocity jet of relatively incompressible fluid, such as water, directing the jet into the hole, and in appropriate position with respect to adjacent free surfaces of the material suddenly arresting the jet in the hole to create a jet stagnation pressure therein of sufficient magnitude and duration or jet repetition rate to break the material towards the free surfaces adjacent the hole.

According to another aspect of the invention there is provided a device for breaking hard compact material, such as rock, into which a bottom hole has been drilled comprising a primary nozzle having means associated therewith to emit therefrom a jet of relatively incompressible fluid, such as water, to be directed into the hole and a secondary nozzle wherefrom a stream of the same fluid being directable towards the hole for filling partially or wholly the hole prior to the generation of the jet from the primary nozzle.

The advantages to be gained by the above method and means are as follows:

(1) The specific energy for rock removal is at least one order of magnitude lower than for a jet impacting a flat surface in which there is no hole. Typically, the values of required specific energy are 1 - 10 $MJ/m^3$.

(2) Breakage is more controllable than with a jet impacting a flat surface, in which there is no hole, the fragmentation depending on the depth of the hole, the shape of the bottom of the hole and the location of the hole relative to the free surfaces or corners of the rock or material to be broken.

(3) The jet velocity necessary to break a given material is lower than for a jet impacting a flat surface in which there is no hole. Typically, the required jet velocity is less than 2000 m/sec. Since the maximum pressure generated in the machine depends on the jet velocity this means that the machine is less liable to fatigue or similar mechanical problems. Typical working pressures are less than 5 kbar.

(4) Since the noise of the jet is related to its velocity the above reduction in velocity also leads to more silent operation.

(5) Compared with hydraulic pressurization there is no longer any need to seal the hole mechanically nor are fissures in the rock a problem, the jet providing a continuous supply of liquid to the hole thereby maintaining the pressure in the hole during the time necessary to fracture the rock. The time is typically 0.1 - 1 milliseconds.

(6) Alignment of the jet with the hole and maintaining the roundness of the hole are less critical than in the case of hydraulic pressurization since the jet is freely deformable whereas the pressurization tube is not.

BRIEF DESCRIPTION OF THE DRAWINGS

Two embodiments of the invention will now be described by way of example with reference to the accompanying drawings, in which.

DETAILED DESCRIPTION

Figure 1:
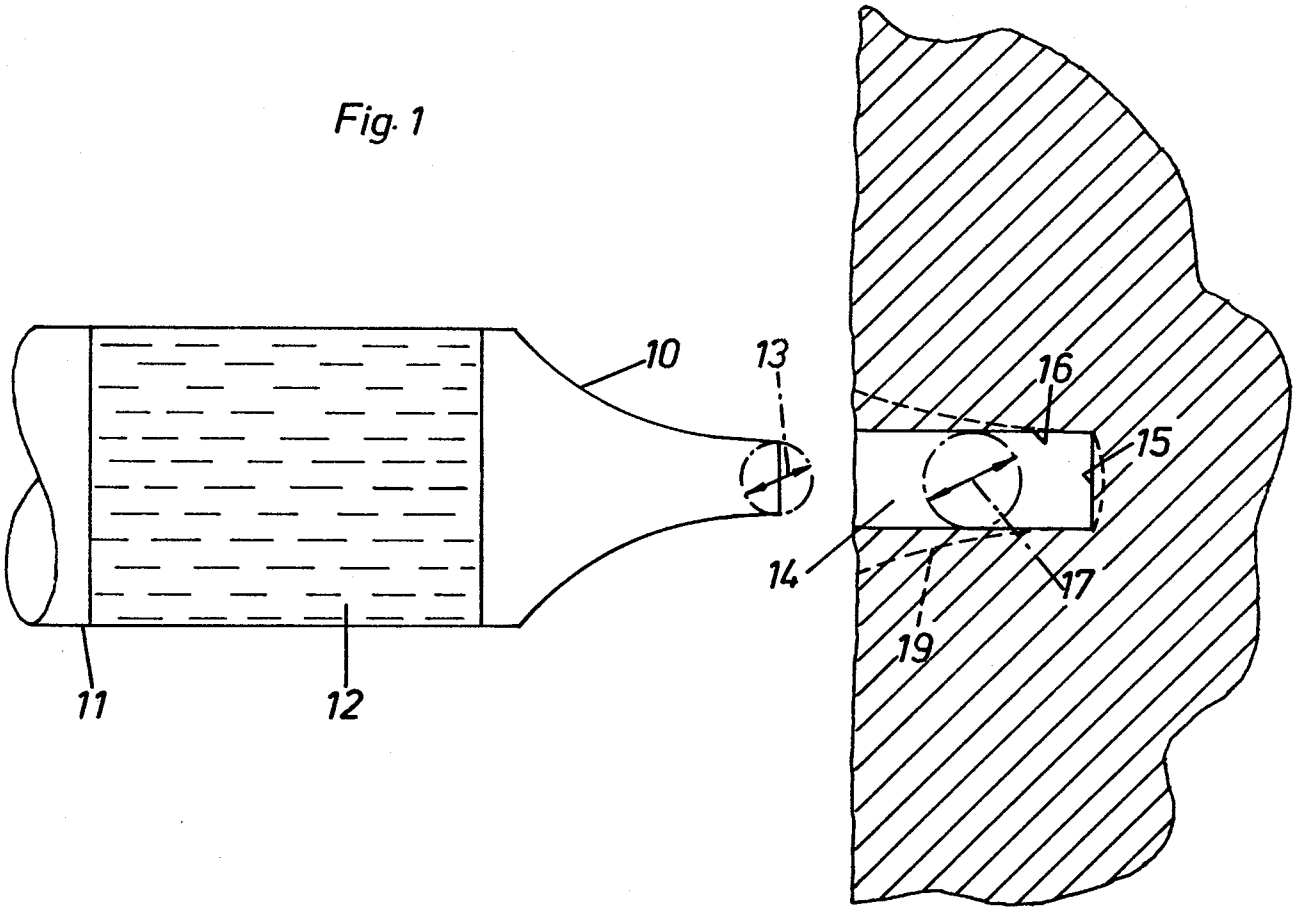
FIG. 1 is a diagrammatic fragmentary view mainly in section of a jet nozzle shown directed towards a hole in a rock face to be broken by the method according to one embodiment of this invention.

In FIG. 1 a nozzle 10 forms part of a jet generator 11, not illustrated in detail, wherein a relatively incompressible fluid 12, such as water, is operated upon by an accelerating pressure fluid, such as compressed air, by piston impact or by other means to provide a high velocity jet out through the free cross section 13 of the nozzle 10. The jet generator may be of any suitable conventional type, for example of the pulsed liquid jet type as described for example in the above mentioned two U.S. patents and in "Bulletin of the Japan Society of Mechanical Engineers", Vol. 18, No. 118, April 1975, pages 358, 359. If several jet pulses in the same hole are needed at high jet repetition rate to fracture the rock satisfactorily, then a device similar to that shown in U.S. Pat. No. 3,883,075 may be used.

In the face of the material or rock to be worked away by incremental fracturing there are drilled bottom holes 14 at suitably chosen intervals, preferably 5 to 10 diameters deep. The hole bottom is designated 15, the cylindrical wall 16 and the free cross section 17. The holes are drilled in any suitable conventional way for example by rotary drilling or combined rotary and percussive drilling.

Figure 2:
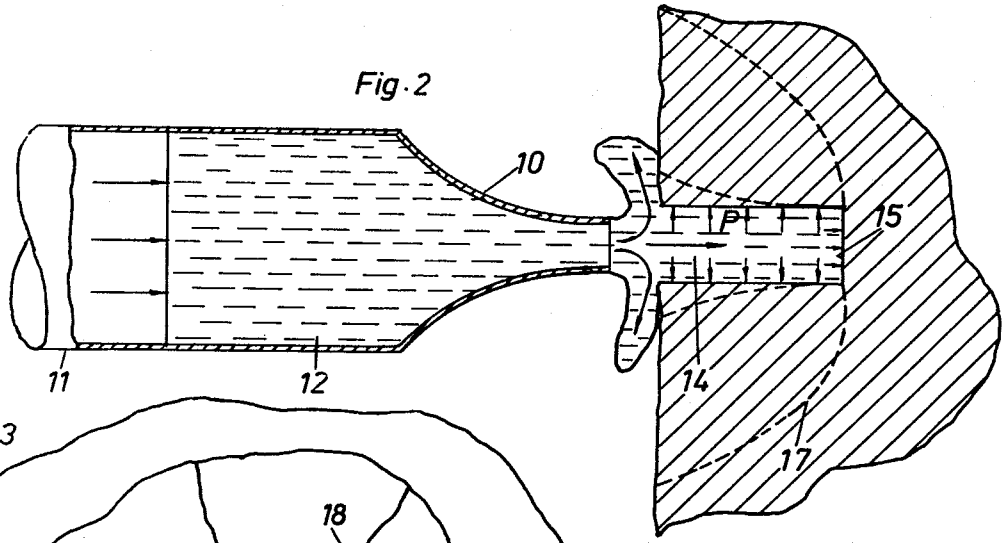
FIG. 2 is a view corresponding to FIG. 1 but illustrating diagrammatically the actual breaking stage of the method.
Figure 3:
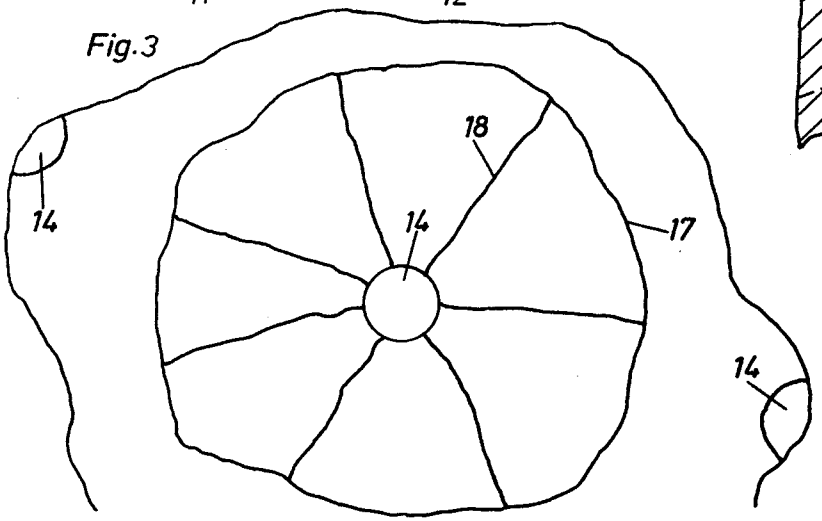
FIG. 3 is a fragmentary front view of the hole in FIG. 2 illustrating a characteristic crack pattern during breaking.

In operation the nozzle is aligned with one of the holes 14 whereupon the jet generator is fired to pulse a high velocity water jet, FIG. 2, into the hole 14. The jet is suddenly arrested by the bottom 15 whereby a jet stagnation pressure P is built up in the hole of sufficient magnitude (in the order of several kilobars) and of sufficient duration and water volume to break the rock by typical mushroom-type cracks 17, FIGS. 2 and 3, and radial cracks 18 directed towards the free surfaces or rock face adjacent the hole 14. The nozzle is thereafter aligned with and a water jet fired into the next adjacent hole 14 and so on thereby working away the rock.

The diameter and depth of the hole to be drilled beforehand depends on the type and quality of the rock and the size of fragments to be removed. Successful breaking was attained in sandstone, limestone and granite with holes varying from $\phi$ 4 mm to $\phi$ 25 mm, 5 to 10 diameters deep. Satisfactory breakage was obtained for water jets whose cross section diameter 13 was between 30 and 100% of the free cross section diameter 17 of the hole with preference for values near 100%. The preferred jet velocity was typically 2000 m/sec. and the jet generator actually used was of cumulative nozzle type wherein a piston was fired by means of 250 bar compressed air onto a stationary water package held at the entrance to the nozzle by means of thin membranes.

In certain applications it may be advantageous to drill the holes by jets of the same liquid, normally water, as used for fracturing. Single high speed liquid jets or a sequence of jets may be used whose diameter is approximately 20 – 40% of that of the hole to be bored, the jets being produced by a conventional device different from that used to create the fracturing jet. Using sandstone, limestone or concrete, holes were drilled by approximately five sequential shots with a pulsed water jet (velocity 1800 m/sec) on the same spot. The resultant holes had a general configuration as shown by broken lines 19 in FIG. 1 with a diameter 3 – 5 times that of the jet and approximately 5 – 10 hole diameters deep.

Another jet drilling alternative is to fire by a jet generator nozzle multiple impacts at progressively increasing energies (jet velocities) by the same jet device to be used first to drill and then to finally fracture the rock. The lower jet velocities used at the beginning of such a drilling-fracturing sequence serve to prevent the formation of fracturing cracks around the hole until a hole depth optimum for fracturing with said jet is obtained. Typically, 5 – 10 such successive impacts are adequate to drill and break the rock.

Figure 4:
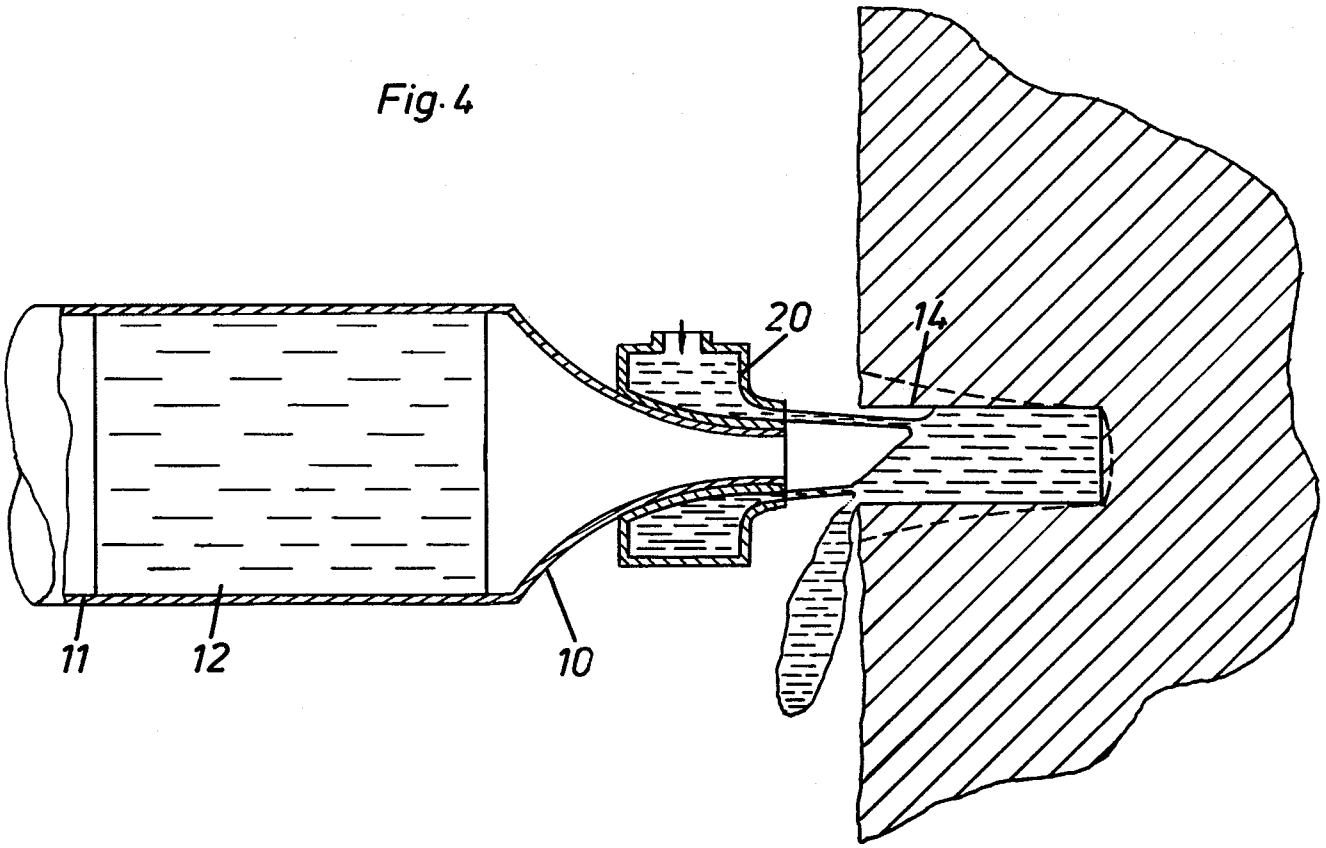
FIG. 4 is a mainly sectional view similar to FIG. 1 but modified to illustrate diagrammatically another embodiment of this invention.

In certain rock formation it is found that filling the hole with liquid can improve the breakage. It is thus desirable to fill the hole with water prior to the impact of the fracturing jet. In FIG. 4 a secondary nozzle or injector 20 is mounted coaxially and annularly around the nozzle 10 for emitting a stream of fluid, i.e. water to fill the hole 14. The low velocity curtain of liquid around the fracturing jet also serves as a shroud to reduce the noise produced by the jet.

The nozzle 10 can within certain limits tolerate angular misalignment with respect to the hole 14 without perceptible loss of breaking efficiency. In such cases the emitted jet first hits and is then reflected by the wall 16 towards the bottom 15 for the proper building up of stagnation pressure.

What we claim is:

1. A method of breaking a hard compact material, such as rock, comprising:

mechanically drilling a substantially cylindrical blind hole in the material to be broken, said material having free surfaces adjacent said hole;

locating a nozzle outside of said hole and in alignment therewith, said nozzle having an internal cavity which has a converging contour leading to a nozzle exit area;

supplying a substantially incompressible fluid to said nozzle to generate a high velocity jet of said substantially incompressible fluid at said nozzle exit area, the smallest cross sectional dimension of said jet being between 30-100% of the free cross sectional diameter of said hole; and directing said jet from said nozzle exit area in the axial direction of said hole toward the bottom of said hole so as to be suddenly arrested upon impact with said hole bottom to create a jet stagnation pressure in said hole to break said material toward adjacent free surfaces of said material.

2. A method according to claim 1, comprising drilling said hole 5 to 10 diameters deep.

3. A method according to claim 1, comprising at least partially filling said hole with substantially incompressible fluid prior to the generation of said jet.

4. A method according to claim 3, comprising wholly filling said hole with said substantially incompressible fluid prior to generation of said jet.

5. A method according to claim 1, wherein the cross sectional diameter of said jet is substantially equal to the free cross sectional diameter of said hole.

6. A method according to claim 1, wherein the outlet of said nozzle is directed to said hole.

7. A method according to claim 1, wherein said jet which is directed in said axial direction of said hole has a sufficient magnitude and duration to create said jet stagnation pressure in said hole to break said material towards said adjacent free surfaces of said material.

8. A method according to claim 1, comprising generating said jet in said axial direction of said hole at a predetermined repetition rate sufficient to break said material towards said adjacent free surfaces of said material.

9. A method according to claim 1, comprising storing a quantity of said substantially incompressible fluid outside of said hole and supplying same to said nozzle.

10. A method according to claim 9, comprising controlling the supply of water to said nozzle by valve means outside said hole.

11. A method according to claim 1, comprising controlling the supply of water to said nozzle by valve means outside said hole.

12. A method according to claim 1, comprising mechanically drilling said blind hole with a substantially sharp transition between the bottom and side walls thereof in order to produce substantially local stress concentration for the initiation of cracks in the vicinity of said transition under the influence of said jet stagnation pressure.

13. A method according to claim 1, comprising locating a nozzle having a continuously converging contour leading to a nozzle exit area outside of said hole and in alignment therewith.

* * * * *